United States Patent [19]

Bush

[11] 4,370,971

[45] Feb. 1, 1983

[54] APPARATUS FOR REMOVING CONTAMINANTS FROM CRANKCASE EMISSIONS

[76] Inventor: Elmer W. Bush, 2010 Trimble Way, Sacramento, Calif. 95825

[21] Appl. No.: 185,051

[22] Filed: Sep. 8, 1980

[51] Int. Cl.[3] ..... F02M 25/06

[52] U.S. Cl. ..... 123/573; 123/572; 123/587

[58] Field of Search ..... 123/572, 573, 574, 41.86, 123/587, 586

[56] References Cited

U.S. PATENT DOCUMENTS

| | | | |
|---|---|---|---|
| 1,286,930 | 12/1918 | Buckner | 123/574 |
| 3,166,061 | 1/1965 | Weiser | 123/572 |
| 3,455,285 | 7/1969 | Sheppard | 123/574 |
| 3,779,221 | 12/1973 | Gartner | 123/573 |
| 4,071,044 | 1/1978 | Jones | 123/573 |
| 4,089,309 | 5/1978 | Bush | 123/573 |

*Primary Examiner*—Ronald H. Lazarus

*Attorney, Agent, or Firm*—Townsend & Townsend

[57] ABSTRACT

Apparatus for receiving crankcase emissions from an internal combustion engine and for separating the liquid and solid portions of the emissions from the gaseous portion thereof. The apparatus includes a container or vessel having an open top which is closed by a cap. The cap has an inlet port for receiving crankcase emissions, an outlet port for permitting the separated gaseous portion of the emissions to be directed through a PVC valve to the intake manifold of the engine, and an air inlet port for allowing ambient air to mix with the crankcase emissions as they are directed toward the interior of the container. The cap carries a porous body which separates the incoming crankcase emissions flowing between the inlet port and outlet port into the liquid, solid and gaseous portions, the liquid and solid portions being trapped in the container while the gaseous portion is permitted to flow toward the outlet port for exit from the container. The vacuum produced in the intake manifold when the engine is operating causes a vacuum in the container which, in turn, causes the crankcase emissions to be drawn into the container. Also, this vacuum unseats a valve in the air intake port against the bias force of a spring to allow ambient air to enter the container and mix with the incoming crankcase emissions and thereby increase the air content of the gaseous portion. When the engine is not operating, the vacuum is no longer present in the container and the valve in the intake port closes by virtue of the bias force of the spring.

8 Claims, 7 Drawing Figures

APPARATUS FOR REMOVING CONTAMINANTS FROM CRANKCASE EMISSIONS

This invention relates to improvements in the control of crankcase emissions from internal combustion engines and, more particularly, to apparatus for receiving such emissions and separating the solid and liquid portions from the gaseous portion thereof.

BACKGROUND OF THE INVENTION

A separator and collector for crankcase emissions of an internal combustion engine has been disclosed in U.S. Pat. No. 4,089,309. Such a separator and collector uses a container or vessel having an open top covered by a cap provided with inlet, outlet and air intake ports. A porous housing containing small discrete particles of inert material is in the container across the path between the inlet port and the outlet port to separate the emissions into liquid, solid and gaseous portions. The cap has a shiftable, spring biased piston which normally closes the air intake port so long as the piston is not subjected to a vacuum by virtue of a connection of the cylinder containing the piston with the distributor vacuum advance unit of the internal combustion engine with which the separator and collector is used. This arrangement has been proven satisfactory but does require that a separate line be connected to the chamber holding the piston with the vacuum advance unit. Notwithstanding the satisfactory operation of this separator and collector, it is desired to improve the construction of the separator and collector to assure more efficient operation with a fewer number of parts and without having to connect the piston chamber with the vacuum advance unit of the distributor of the engine.

SUMMARY OF THE INVENTION

The present invention is directed to an improvement on the separator and collector of the above-mentioned patent to simplify the construction of the separator and collector and to make it more efficient in operation and less costly to produce. To this end, the present invention provides an improved separator and collector in which an air intake port is used but such port is not required to be coupled to the distributor vacuum advance unit of the engine to control a piston as in the patent. Instead, the air intake port of the present invention has a spring-biased valve which is opened by a vacuum in the container of the separator and collector, such vacuum being produced merely by virtue of the connection of the outlet port with the air intake manifold of the engine. The valve in the air intake port closes the air intake port when no vacuum is in the container yet the valve will immediately open when the container is again subjected to a vacuum. Thus, the separator and collector of this invention can be constructed with a fewer number of parts than that of the above patent to minimize costs of production, assembly and maintenance.

The primary object of this invention is to provide improved apparatus for separating crankcase emissions into liquid, solid and gaseous fractions and allowing the gaseous fraction to be directed to the air intake manifold of an engine from which the emissions are taken wherein an improved air intake means is provided for the apparatus to simplify the construction of the apparatus and to reduce the number and complexity of parts which ordinarily would be used to provide for mixing of ambient air with the incoming emissions to the apparatus.

Another object of this invention is to provide a separator and collector for crankcase emissions in which an air intake port has a valve which opens in response to vacuum within the collector itself to eliminate the need for providing a separate vacuum line to another part of the engine as has been required in earlier versions of the separator and collector.

Other objects of this invention will become apparent as the following specification progresses, reference being had to the accompanying drawings for an illustration of the invention.

IN THE DRAWINGS

Figure 1:
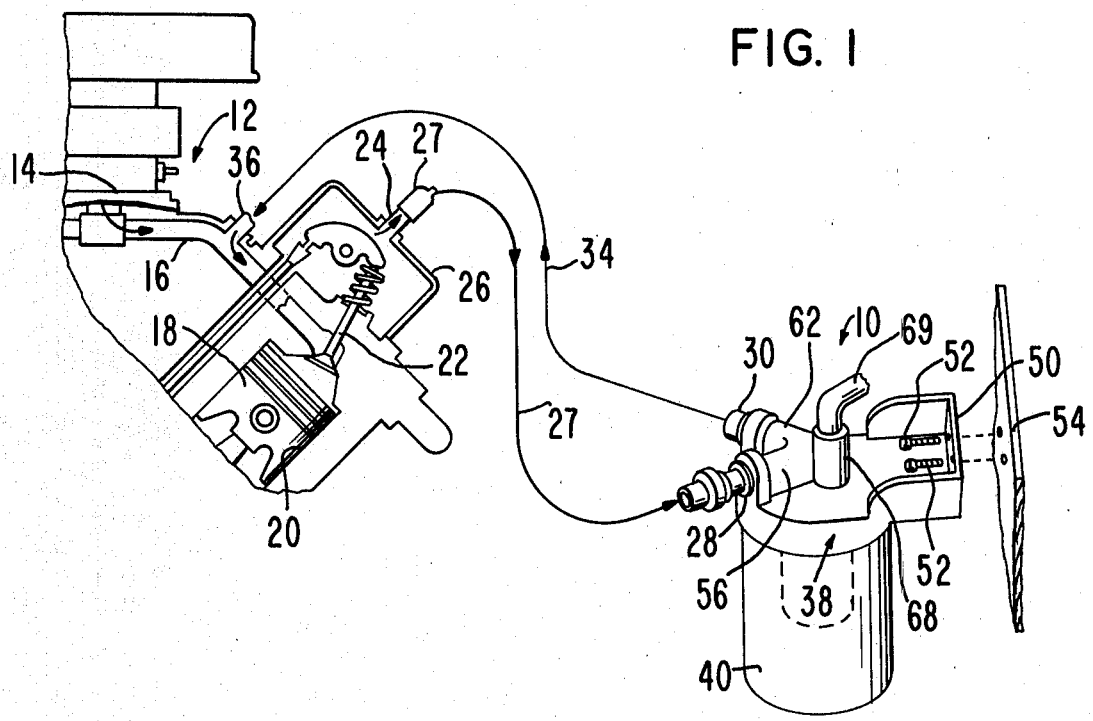
FIG. 1 is a perspective view, partly schematic, of the apparatus of the present invention, showing the way in which it is coupled to an internal combustion engine for receiving crankcase emissions from the engine and for returning gaseous products to the intake manifold of the engine.

The apparatus for separating crankcase emissions into liquid, solid and gaseous fractions and for collecting the liquid and solid fractions while permitting re-use of the gaseous fraction is broadly denoted by the numeral 10. Apparatus 10 is illustrated in FIG. 1 with an internal combustion engine 12 having a carburetor 14, an intake manifold 16, a piston 18 shiftably mounted within a cylinder 20 and provided with a valve 22 for controlling the air-fuel mixture to the combustion chamber of the cylinder to drive the piston in one direction in the cylinder. Crankcase emissions in the form of "blow-by" gases are emitted from the engine through a port 24 in the rocker arm cover 26 of the engine and these gases are directed through a PCV valve 27 to the inlet port 28 of apparatus 10 for processing and treatment by the apparatus in a manner to be described. These "blow-by" gases consist of the unburned air-fuel mixture and combustion products, including water, carbon dioxide, carbon monoxide and sludge particles. It is the purpose of the apparatus 10 to separate these various forms of emissions so that the contaminants, namely the liquids and solids, can be removed from the gaseous fraction containing unused combustion products which can be returned to the intake manifold of the engine for forming part of the air-fuel mixture directed to the combustion chamber or chambers of the engine. The gaseous fraction leaves apparatus 10 through outlet port 30 and then along line 34 to an inlet port 36 coupled to the intake manifold 16. A vacuum is created at the intake manifold and this vacuum, through line 34, partially evacuates apparatus 10 for a purpose to be described.

Apparatus 10 includes a cap 38 (FIG. 2), a container or vessel 40, and a separator unit 42. For purposes of illustration, container 40 is a glass jar having an externally threaded neck 44 which is threadably coupled to the internally threaded skirt 46 of cap 38. The jar is transparent so that the contaminants collected in the jar can be observed to determine when the jar is to be emptied.

Figure 2:
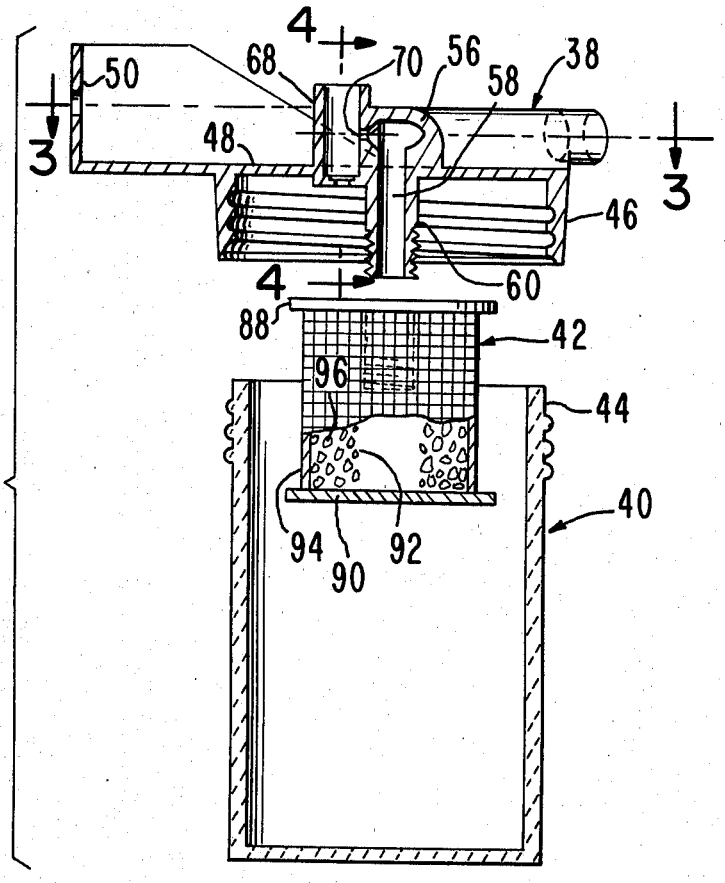
FIG. 2 is an exploded view, partly in section of the apparatus, showing the cap, the container, and the separator in the container and coupled to the cap, the parts being separated to illustrate details of construction.

Cap 38 includes a top wall 48 and a side flange 50 which is adapted to be secured by screws 52 to a fire wall 54 or other fixed support on the vehicle in which engine 12 is mounted. Cap 38 has a first tubular projection 56 whose outer end defines the inlet port 28. Projection 56 has a passage 57 which communicates with an internal passage 58 defined by a stem 60 secured to and extending downwardly from top wall 48 as shown in FIG. 2. The lower end of stem 60 is externally threaded so as to be threadably mounted to the upper end of collector unit 42.

Figure 3:
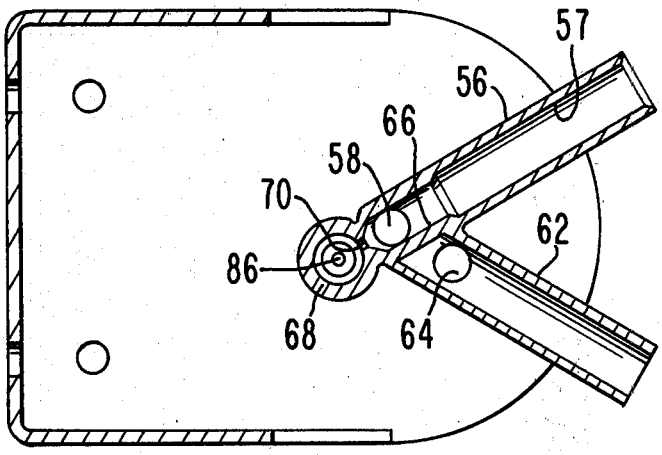
FIG. 3 is an enlarged cross-sectional view taken along line 3—3 of FIG. 2.
Figure 4:
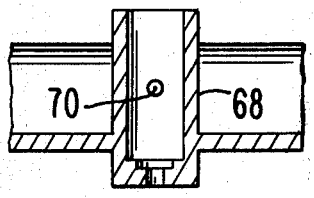
FIG. 4 is an enlarged cross-sectional view taken along line 4—4 of FIG. 2.

A second tubular projection 62 (FIG. 1) is carried by cap 38 at an angle with reference to projection 56. The outer end of projection 62 defines outlet port 30 which is coupled to line 34 with suitable fittings. Projection 62 communicates with the interior of container 40 through a passage in the projection and through a hole 64 (FIG. 3) which passes through top wall 48. A barrier wall 66 separates the passages through projection 56 and 62 as shown in FIG. 3.

A third tubular projection 68 is carried by cap 38. The projection 68 is generally vertically disposed and has an upper open end and air intake port 70 as shown in FIGS. 2, 3, 4 and 5. This air intake port is in communication with the passage 57 in the manner shown in FIGS. 2 and 3 so that air can enter passage 57 and mix with the incoming emissions before they pass through collector unit 42. A fitting 69 (FIG. 1) can be mounted on the upper end of projection 68 to couple an air filter to the projection, if desired.

Figure 5:
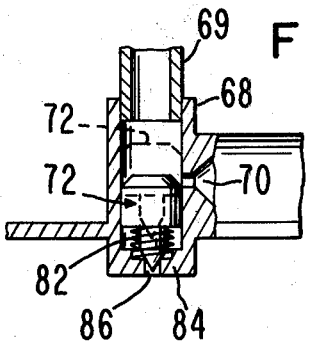
FIG. 5 is a view similar to FIG. 4 but showing the open and closed positions of the valve near the air intake port on the cap.
Figure 6:
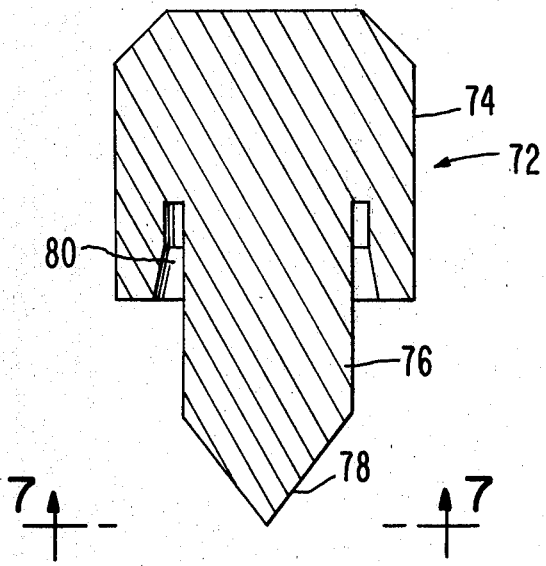
FIG. 6 is an enlarged cross-sectional view of the valve.
Figure 7:
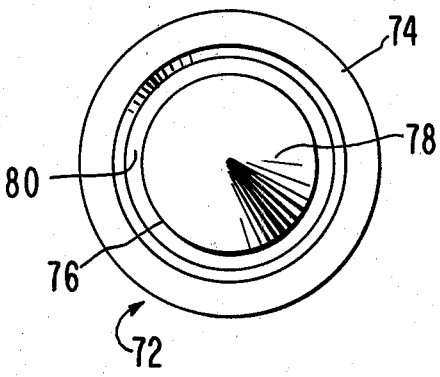
FIG. 7 is an end elevational view of the valve looking in the direction of line 7—7 of FIG. 6.

A valve member 72 is slidably mounted in projection 68 in the manner shown in FIG. 5. Valve member 72 has a vertical cross-section as shown in FIG. 6 and typically is formed from rubber or other suitable material, such as Buna. The valve member has an enlarged upper portion 74 and a reduced lower portion 76 provided with a conical lower end 78. An annular groove 80 is formed in valve member 72 for receiving one end of a coil spring 82 (FIG. 5) which biases the valve member toward the dashed line position shown in FIG. 5. In such dashed line position, the valve member effectively closes air intake port 70 so that substantially no ambient air can enter passage 57 to mix with any emissions therein.

Projection 68 has a bottom wall 84 provided with a hole 86 therethrough which places the interior of projection 68 in fluid communication with the interior of container 40. When a vacuum or reduced air pressure is in container 40, such as by virtue of its being connected through outlet port 30 and line 34 to the intake manifold 16 of engine 12, this reduced pressure is transmitted through hole 86 to the lower part of the interior of projection 68. This causes valve member 72 to be drawn towards bottom wall 84 and into the full line position of FIG. 5, opening air intake port 70 and allowing ambient air to enter passage 57 and mix with emissions flowing through such passage and into passage 58.

Separator unit 42 includes upper and lower disks 88 and 90, an inner screen 92 and an outer screen 94. The screens define a space for containing a plurality of particles 96 in the annular space between the screens. Particles 96 are relatively inert and are typically formed of glass or fiber glass having a diameter of about 3 mm. or less. The particles define a large surface area and many tortuous channels through which the emissions must pass in flowing into the container and out of the container through the outlet port 30. The particles themselves undergo no change yet separation of the liquid and solid fractions of the incoming emissions from the gaseous fraction is quickly effected.

In use, apparatus 10 is coupled to engine 12 in the manner shown in FIG. 1. During operation of the engine, the crankcase emissions in the form of "blow-by" gases are drawn by suction through apparatus 10 by virtue of the vacuum generated at the intake manifold 16 of the engine. As the emissions enter passage 57, they are mixed with incoming ambient air because valve member 72 is in the open, full line position shown in FIG. 5 when vacuum is in container 40. Then the mixture of the air and emissions passes through unit 42 where liquids and solids are separated from the gaseous fraction and the gaseous fraction flows out of apparatus 10 through opening 64, passage 63, through the PCV valve 32, through line 34 and through inlet port 36 of intake manifold 16. The gaseous fraction is then redirected along with the air-fuel mixture into the combustion chamber of the engine. In this way, such gaseous fraction from the emissions is used as part of the air-fuel mixture.

I claim:

1. Apparatus for processing crankcase emissions of an internal combustion engine having an intake manifold comprising: a container having an inlet port, an outlet port, and an ambient air intake port, the ports communicating with the interior of the container, said inlet port adapted to receive crankcase emissions from said engine, there being means in the container for separating the crankcase emissions into liquid, solid and gaseous fractions, the outlet port adapted to be coupled to the intake manifold of the engine so that the interior of the container will be subject to the vacuum of the intake manifold; a valve member; means coupled with the container for mounting the valve member for movement into and out of an operative position closing said air intake port; means for providing fluid communication between the interior of said container and said valve member so that said valve member is movable out of said operative position as a function of the vacuum in said container;

and means for biasing said valve member toward said operative position.

2. Apparatus as set forth in claim 1, wherein the container includes a vessel having an open top and a cap for closing the open top, the inlet, outlet and air intake ports being on the cap.

3. Apparatus as set forth in claim 1, wherein the container has a top wall provided with a hole therethrough for providing said fluid communication between the interior of said container and said valve member, there being a tubular projection extending upwardly from the top wall in surrounding relationship to the hole, the air intake port extending through the projection and communicating with the inlet port, said valve being shiftably mounted in the projection.

4. Apparatus as set forth in claim 3, wherein said bias means defines a coil spring in said projection and surrounding at least a portion of the valve member, said spring normally being under compression when said valve member is out of said operative position.

5. For use with a crankcase ventilation system connected to an internal combustion engine having an intake manifold and a crankcase, a fluid separator device for conditioning crankcase emissions comprising: a collecting vessel; a cap removably secured to one end of said vessel; means defining a fluid inlet passage in said cap, said inlet passage adapted to be coupled with the crankcase to receive crankcase emissions therefrom; an outlet passage in said cap, the outlet passage adapted to be coupled with the intake manifold to direct gaseous fractions from said emissions to the intake manifold in response to the vacuum generated therein; means within the collecting vessel for separating the liquid and solid fractions of the emissions from the gaseous fraction of the emissions whereby only the gaseous fraction will leave said collector through said outlet passage as a function of the vacuum in said intake manifold; and means for introducing atmospheric air into said device through said inlet passage, said air introducing means including means defining an air intake port communicating with said inlet passage, a valve member, means mounting the valve member for movement from a first position closing the air intake port to a second position opening the air intake port to the atmosphere, said mounting means including a tubular projection secured to said cap and extending outwardly therefrom, the outer end of the projection being open, the inner end of the projection having a wall provided with a hole therethrough for placing the interior of the projection in fluid communication with the vessel, said valve member being slidable in the projection, said means biasing the valve member into the first position, said mounting means permitting the valve member to move from the first position to the second position as a function of the vacuum generated at the air intake manifold.

6. Apparatus as set forth in claim 5, wherein the bias means includes a spring between the valve member and said wall.

7. Apparatus as set forth in claim 6, wherein said spring is a coil spring, said valve member having an annular space for receiving one end of the coil spring, the opposite end of the coil spring engaging the wall of the projection.

8. Apparatus as set forth in claim 5, wherein said projection has a side wall and said intake port extends through the side wall.

* * * * *